United States Patent [19]

Itoh et al.

[11] 4,292,401

[45] Sep. 29, 1981

[54] BLEACHING COMPOSITION FOR PHOTOGRAPHIC PROCESSING

[75] Inventors: Isamu Itoh; Taiji Hashimura; Takatoshi Ishikawa, all of Minami-ashigara, Japan

[73] Assignee: Fuji Photo Film Co., Ltd., Minami-ashigara, Japan

[21] Appl. No.: 139,038

[22] Filed: Apr. 10, 1980

[30] Foreign Application Priority Data

Apr. 12, 1979 [JP] Japan ..... 54/44621

[51] Int. Cl.[3] ..... G03C 5/32

[52] U.S. Cl. ..... 430/393; 430/430; 430/461

[58] Field of Search ..... 430/460, 461, 430, 431, 430/393, 400, 427

[56] References Cited

U.S. PATENT DOCUMENTS

| | | | |
|---|---|---|---|
| 3,772,020 | 11/1973 | Smith | 430/393 |
| 3,870,520 | 3/1975 | Shimamura et al. | 430/461 |
| 3,893,858 | 7/1975 | Wabnitz | 430/393 |
| 4,075,014 | 2/1978 | Gerhardt | 430/393 |
| 4,144,068 | 3/1979 | Ishibashi et al. | 430/393 |
| 4,163,669 | 8/1979 | Kanada et al. | 430/393 |

*Primary Examiner*—Mary F. Downey

*Attorney, Agent, or Firm*—Sughrue, Mion, Zinn, Macpeak and Seas

[57] ABSTRACT

A bleaching composition for use in processing silver halide color photographic light-sensitive material, comprising compounds [I], [II], and [III] as follows:

Compound [I]: at least one compound selected from the group consisting of a persulfate, an inorganic ferric salt, and an organic acid ferric complex;

Compound [II]: a water-soluble halide; and

Compound [III]: at least one compound selected from the compounds represented by following general formula [III];

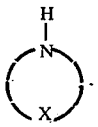

wherein X represents carbon atoms or carbon and nitrogen atoms forming an unsubstituted or substituted 5-membered ring containing two unsaturated bonds, including a 5-membered ring fused with a 5- or 6-membered carbocyclic or heterocyclic ring.

28 Claims, No Drawings

BLEACHING COMPOSITION FOR PHOTOGRAPHIC PROCESSING

BACKGROUND OF THE INVENTION

1. Field of the Invention

This invention relates to a bleaching composition for use in processing silver halide color photographic light-sensitive materials. More particularly, it pertains to a bleaching composition which prevents generation of harmful gases like halogen gas from a bleaching solution containing a bleaching agent and a halide.

2. Description of the Prior Art

In photographic processing of silver halide color photographic light-sensitive materials, the light-sensitive material (the silver halide photographic emulsion may be previously fogged) is usually imagewise exposed, and developed in a developer containing an aromatic primary amine in the presence of a dye-forming coupler to obtain a color image, whereas the simultaneously produced silver deposit is re-halogenated in the bleaching step and removed by fixing or bleach-fixing.

It has heretofore been known to use as a bleaching agent, red prussiates (ferricyanates), dichromates, ferric salts, organic acid ferric complexes, persulfates, or the like, and, as a re-halogenating agent, water-soluble halogenides such as ammonium chloride, sodium bromide, or the like. Of the above-described bleaching agents, ferricyanates are good bleaching agents in that they provide a sufficiently high bleaching rate (oxidation rate) to fully oxidize the silver deposit within a practically acceptable time. However, a bleaching solution containing red prussiate as a bleaching agent undergoes photolysis and release cyanide ion which causes environmental pollution. As a consequence, the waste solution must be decontaminated. Also, a bleaching solution containing dichromate must be decontaminated, after bleaching, so as not to discharge dichromate ion harmful which is from the standpoint of maintaining a sanitary environment. Conventional compositions which require decontamination treatments impose a serious burden on their industrial application.

It has been known to use persulfates, inorganic ferric salts, organic acid ferric complexes, etc. as a bleaching solution so as to remove the drawbacks of red prussiates or dichromates. In the case of using such bleaching agents, there are the following defects: Some of the bleaching agents are not soluble in a weakly acidic or alkaline solution and, in addition, a sufficiently high bleaching rate is difficult to attain. Thus, in many cases, the pH of the bleaching solution must be adjusted to a low level to remarkably strengthen the oxidizing power, thus the bleaching rate is increased. Adjustment of the pH to a low level to strengthen the oxidizing power is also effective using the aforesaid dichromate but, considering the treatment of the waste solution, the adjustment is particularly effective using persulfates or ferric salts because the load is comparatively light. However, adjusting the pH of the bleaching solution containing persulfate, inorganic ferric salt or organic acid ferric complex to a low level results in reaction between the chloride or bromide used in the system as the re-halogenating agent and the oxidizing agent and generation of the chlorine or bromine, which is a serious problem in the working environment. Further, the production of chlorine or bromine is accompanied by corrosion of developing equipment. Therefore, practical application of the bleaching process using persulfates or ferric salts as a bleaching agent is extremely difficult unless the above-described defects are removed.

As the compounds capable of preventing the production of chlorine or bromine due to oxidation of the chloride or bromide in the bleaching solution, there have been proposed gelatin, various amino acids, aliphatic monocarboxylic acids, cobalt salts, etc. as described in *Research Disclosure,* 17556 (Nov., 1978). However, many of these compounds do not sufficiently preventing generation of chlorine or bromine, while those which exhibit excellent gas generation-preventing effect have the defect of giving off other malodors, corroding the processing equipment, poor stability, accelerating decomposition of the persulfate to shorten the effective life of bleaching solution and reduce the bleaching ability, or suffering a serious change in the pH of the bleaching solution, thus showing poor stability.

SUMMARY OF THE INVENTION

It is therefore an object of the present invention to provide a bleaching composition which does not cause environmental pollution and which provides a high bleaching rate.

Another object of the present invention is to provide a bleaching composition which does not generate a harmful halogen gas.

A further object of the present invention is to provide a bleaching composition which does not corrode photographic processing equipment.

Still a further object of the present invention is to provide a bleaching composition which depresses decomposition of a bleaching agent in the bleaching solution and thus depresses changes in the pH of the bleaching solution, which stably maintains the bleaching power, and which enables a reduction in the amount of supplementary bleaching agent.

Still a further object of the present invention is to provide a process for bleaching a silver halide color photographic light-sensitive material using a bleaching composition attaining the above-described objects.

DETAILED DESCRIPTION OF THE INVENTION

The above-described objects are attained by a bleaching composition containing compounds [I], [II], and [III] as defined below:

Compound [I]: at least one compound selected from the group consisting of a persulfate, an inorganic ferric salt, and an organic acid ferric complex;

Compound [II]: a water-soluble halide; and

Compound [III]: at least one compound represented by following formula [III];

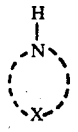

wherein X represents carbon atoms or carbon and nitrogen atoms forming an unsubstituted or substituted 5-membered ring containing two unsaturated bonds, including a 5-membered ring fused with a 5-membered or 6-membered carbocyclic or heterocyclic ring.

Preferred examples of compound [III] are represented by following general formula [III-a] or [III-b]:

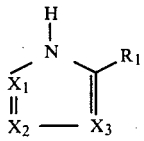

[III-a]

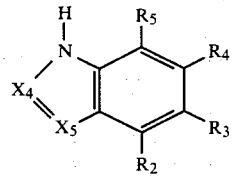

[III-b]

wherein $X_1$, $X_2$, $X_3$, $X_4$, and $X_5$ may be the same or different and each represent a nitrogen atom or a group represented by the formula C-R wherein R represents a hydrogen atom, a straight chain or branched chain alkyl group, a straight chain or branched chain alkenyl group, a monocyclic aryl group having 6 to 8 carbon atoms, a straight chain alkoxy group, an amino group, an acyl group, a cyano group, a nitro group, a sulfo group, or a halogen atom (e.g., chlorine or bromine), $R_1$, $R_2$, $R_3$, $R_4$, and $R_5$ may be the same or different from each other, and have the same definition as R.

Preferred examples of the 5-membered ring completed by X include a pyrrole ring, an imidazole ring, a pyrazole a 1,2,3-triazole ring, a 1,2,4-triazole ring, a tetrazole ring, an indole ring, an indazole ring, a benzimidazole ring, a benzotriazole ring, a triazaindene ring, a tetrazaindene ring, etc.

The alkyl group, alkenyl group, aryl group, alkoxy group, amino group, and acyl group represented by R may bear substituents. For example, they may be substituted by an alkyl group, an alkenyl group, an aryl group, an alkoxy group, a hydroxy group, or halogen atom. The number of carbon atoms for the alkyl group, the alkenyl group, and the alkoxy group represented by R is not limited, though 1 to 4 carbon atoms is preferred.

The acyl group represented by R is preferably an aliphatic acyl group having 2 to 5 carbon atoms.

Specific examples of the substituents represented by R include a methyl group, an ethyl group, a propyl group, an isopropyl group, a hydroxymethyl group, a hydroxyethyl group, an amino group, an acetyl group, a cyano group, a chlorine atom, a bromine atom, a methoxy group, an ethoxy group, an nitro group, a phenyl group, a p-methoxyphenyl group, a p-tolyl group, a dimethylamino group, a diethylamino group, etc.

The detailed mechanism whereby the compound of the present invention prevents generation of chlorine or bromine is not clear, but it is believed the >N—H group in the heterocyclic ring reacts with chlorine or bromine to form a stable >N—Cl or >N—Br. On the other and, aliphatic amines or nitrogen-containing saturated heterocyclic compounds show less halogen generation-preventing effect than the compounds of the present invention, possess extremely poor stability in a bleaching solution, and cause problems such as acceleration of decomposition of the bleaching agent and thus they fail to attain the objects of the present invention. As a consequence, it is considered important in preventing generation of chlorine or bromine that the >NH group in the compounds of the present invention form a 5-membered heterocyclic ring having two unsaturated bonds in a conjugated relation.

Preferred specific examples of the compounds of formula [III] used in the present invention are illustrated below.

Illustrative compounds:

(1)

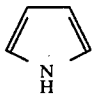

(2)

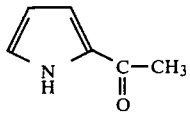

(3)

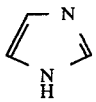

(4)

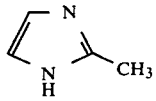

(5)

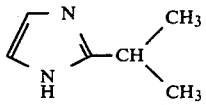

(6)

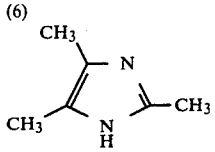

(7)

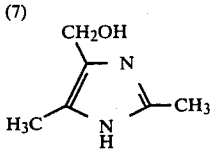

(8)

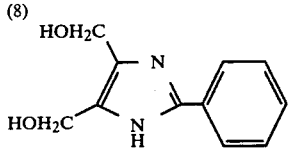

(9)

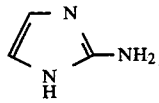

(10)

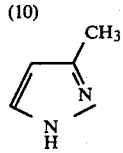

(11)

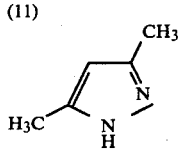

(12)

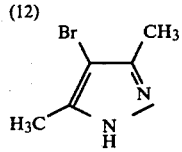

(13)

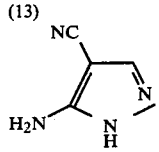

(14)

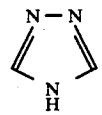

(15)

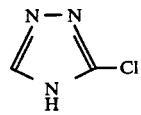

(16)

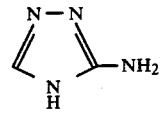

(17)

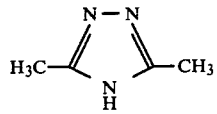

(18)

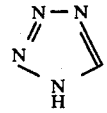

(19)

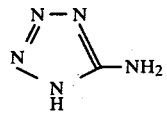

(20)

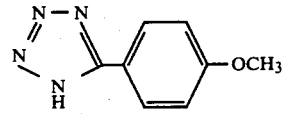

(21)

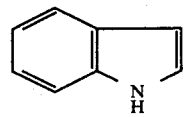

(22)

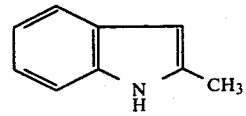

(23)

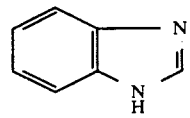

(24)

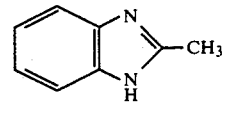

(25)

(26)

-continued

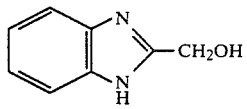
(27)

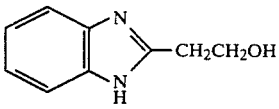
(28)

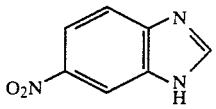
(29)

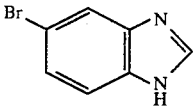
(30)

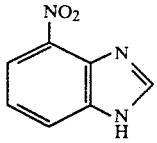
(31)

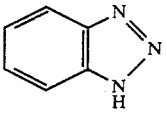
(32)

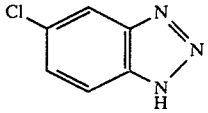
(33)

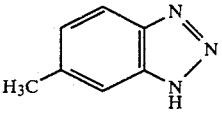
(34)

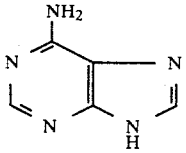
(35)

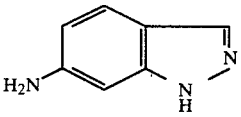
(36)

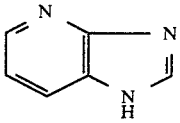

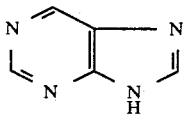

The persulfates preferably used as a bleaching agent (compound [I]) in the composition of the present invention are alkali metal persulfates such as potassium persulfate, sodium persulfate, etc., or ammonium persulfate. Also, preferred inorganic ferric salts include ferric chloride, ferric bromide, ferric sulfate, ferric nitrate, etc. and preferred organic acid ferric complexes include ferric complexes of ethylenediaminetetraacetic acid, diethylene-triaminepentaacetic acid, nitrilotriacetic acid, propylenediaminetetraacetic acid, cyclohexanediamine-tetraacetic acid, etc. The above-described bleaching agents are contained in the bleaching solution preferably in amounts of about 0.1 to 2 mols per liter of the bleaching solution.

The bleaching composition of the present invention can contain, as compound [II], chlorides such as potassium chloride, sodium chloride, ammonium chloride, etc. or bromides such as potassium bromide, sodium bromide, ammonium bromide, etc. These halides are contained in the bleaching composition of the present invention preferably in amounts of about 0.1 to 2 mols per liter of the bleaching solution.

Additionally, the bleaching solution may contain one or more inorganic acids and the salts thereof having a pH-buffering ability such as boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc. Further, such salts as sodium sulfate, potassium sulfate, etc. may be added to adjust the ionic strength in the bleaching solution.

Various bleaching accelerators may be used in combination with processing in accordance with the present invention. For example, mercapto compounds, dithiocarbamate compounds, etc. described in U.S. Pat. Nos. 3,707,374, 3,772,020, 3,893,858, Japanese Patent Publication No. 28227/76, Japanese Patent Application (OPI) Nos. 94927/78, 95631/78 (The term "OPI" as used herein refers to a "published unexamined Japanese patent application".), Japanese Patent Application Nos. 97980/78, 98901/78, and *Research Disclosure,* 15704 (May, 1977) can preferably be used in amounts of about $1\times10^{-4}$ to $2\times10^{-1}$ mol per liter of the bleaching solution.

As the above-described bleaching accelerators, mercapto group-containing compounds represented by the following formula [IV]:

$$X—A—SH \qquad [IV]$$

or precursors thereof are specifically preferred. In the above formula, A represents an alkylene group or a nitrogen-containing divalent heterocyclic ring, and X represents an alkyl-substituted or unsubstituted amino group, nitrogen-containing saturated heterocyclic ring, hydroxy group, carboxy group or sulfo group. Of these compounds, compounds represented by the following formula [V] or precursors thereof are particularly preferred.

$$X—(CH_2)_n—SH \qquad [V]$$

In the above formula, X represents an N,N-dimethylamino group, an N,N-diethylamino group, a hydroxy group or a sulfo group, and n represents an integer of 2 or 3.

Preferred, representative examples of the compounds represented by the above formulae [IV] and [V] or precursors thereof are:

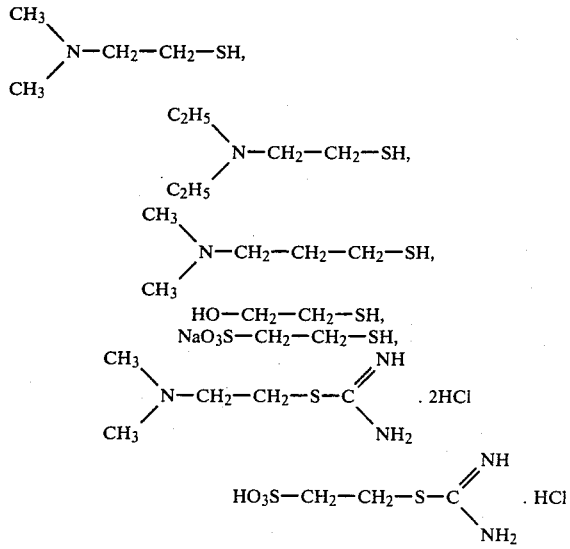

The above-described bleaching accelerators may be added to processing baths provided for color development or provided after color development and before bleaching, such as a color-developing bath, a mere water-wash bath, a stopping bath or a stop-fixing bath as well as in the bleaching bath.

In the case of preparing a bleaching solution using the bleaching composition of the present invention, an aqueous solution containing the ingredients other than compound [III] may be prepared, immediately followed by adding thereto the aforesaid compound [III] as a solid or an aqueous solution, or an aqueous solution containing ingredients other than compound [I] may be prepared, followed by finally adding thereto the bleaching agent (compound [I]) as a solid or an aqueous solution. In preparing the bleaching solution, the absence of the compound [III] of the present invention results in gradual generation of chlorine or bromine, which deteriorates the working environment so seriously that working is difficult to continue. However, addition of the aforesaid compound [III] completely prevents generation of chlorine and bromine and does not produce malodors. Thus, it is not necessary to take into consideration application of protecting wear or vapor exhausts.

The compounds of the present invention represented by the formulae [III], [III-a] and [III-b] are used in amounts of about $2\times10^{-6}$ to $1\times10^{-1}$ mol, preferably about $1\times10^{-2}$ to $4\times10^{-2}$ mol, per liter of the bleaching solution. The pH of the bleaching solution is preferably about 1.0 to 7.0, particularly preferably about 2.0 to 6.0, upon use.

The present invention can be applied to processing all color light-sensitive materials containing silver halide, such as color paper, color negative film, color reversal film, color positive film, etc. Particularly excellent effects can be obtained when the present invention is applied to processing light-sensitive materials wherein the total silver content of the silver halide emulsion layers is about 30 mg or more per 100 $cm^2$. It is particularly advantageous to apply the present invention to light-sensitive materials wherein the total silver amount content is about 40 mg or more per 100 $cm^2$.

Processing imagewise exposed color negative film, color positive film, color paper, etc. using the bleaching composition of the present invention usually involves the following fundamental steps, carried out at a temperature of from about 20° to 60° C., and more preferably between 30° to 40° C., for a time from about 1 to 8 minutes, and more preferably for from 1.5 to 6 minutes.

(1) Color development→stopping→bleaching→washing→fixing→washing→stabilizing→drying;
(2) Color development→stopping→bleaching→fixing→washing→stabilizing→drying; or
(3) Color development→stop-fixing→bleaching→fixing→washing→stabilizing→drying.

In these processes (1) to (3), a pre-bath, a hardening bath, etc., may further be provided before color development, and the stabilizing bath or washing after bleaching may be omitted.

On the other hand, processing color reversal film usually involves the following fundamental steps:

(4) Black-and-white development→stopping→washing→fogging→washing→color development→stopping→washing→bleaching→washing→fixing→washing→stabilizing→drying; or
(5) Black-and-white development→stopping→washing→fogging→washing→color development→stopping→washing→bleaching→fixing→washing→stabilizing→drying.

In these processes (4) and (5), a pre-bath, a pre-hardening bath, a neutralizing bath, etc. may be further provided. Also, the stabilizing bath, washing after bleaching, and the like may be eliminated. The fogging bath may be replaced by re-exposure, or may be eliminated by adding a fogging agent to the color developer.

Although the above-described processes (1) to (5) are useful in photographic processing according to the present invention, those skilled in the art will appreciate other processes are available and those above do not limit the present invention in any way.

The present invention will now be described in more detail by the following non-limiting examples.

EXAMPLE 1

650 ml of each of bleaching solutions (A) to (H) prepared according to the following formulations was placed in a 1-liter, narrow-necked polyethylene bottle equipped with a rubber stopper, and an iron piece was suspended by a piece of string from the rubber stopper over the liquid surface, followed by tightly closing the bottle with the stopper. Then, the bottles were maintained at 40° C. for 7 days, provided that part of the gas within each bottle was sampled every day to check for chlorine gas and to check for generation of odors other than chlorine gas. Also, each iron piece suspended within the bottle was examined for the formation of rust. Determination of the chlorine gas was conducted using a conventional chlorine gas-detecting tube (Kitagawa's), and generation of odors other than chlorine gas was checked by the sense of smell.

Bleaching solution (A) contained no compounds capable of preventing generation of chlorine gas. Bleaching solutions (B), (C), and (D) were comparative bleaching solutions containing compounds other than those of the formula [III] of the present invention. Bleaching solutions (E), (F), (G), and (H) are bleaching solutions containing compounds of formula [III].

The formulations of the bleaching solutions are shown below.

| | |
|---|---|
| Bleaching solution (A): | |
| Water | 800 ml |
| Sodium Persulfate | 60 g |
| Sodium Chloride | 30 g |
| Phosphoric Acid (85%) | 11.8 ml |
| Sodium Hydroxide | 6.4 g |
| Water to make | 1 liter |
| pH | 2.7 |
| Bleaching solution (B): | |
| Water | 800 ml |
| Sodium Persulfate | 60 g |
| Sodium Chloride | 30 g |
| Phosphoric Acid (85%) | 11.8 ml |
| Sodium Hydroxide | 6.4 g |
| Triethanolamine | 3.3 g |
| Water to make | 1 liter |
| pH | 3.6 |
| Bleaching solution (C): | |
| Water | 800 ml |
| Sodium Persulfate | 60 g |
| Sodium Chloride | 30 g |
| Phosphoric Acid (85%) | 11.8 ml |
| Sodium Hydroxide | 6.4 g |
| Glycine | 1.7 g |
| Water to make | 1 liter |
| pH | 3.3 |
| Bleaching solution (D): | |
| Water | 800 ml |
| Sodium Persulfate | 60 g |
| Sodium Chloride | 30 g |
| Phosphoric Acid (85%) | 11.8 ml |
| Sodium Hydroxide | 6.4 g |
| β-Alanine | 2.0 g |
| Water to make | 1 liter |
| pH | 3.4 |
| Bleaching solution (E): | |
| Water | 800 ml |
| Sodium Persulfate | 60 g |
| Sodium Chloride | 30 g |
| Phosphoric Acid (85%) | 11.8 ml |
| Sodium Hydroxide | 6.4 g |

-continued

| | |
|---|---|
| Illustrative compound (3) | 1.5 g |
| Water to make | 1 liter |
| pH | 2.9 |
| Bleaching solution (F): | |
| Water | 800 ml |
| Sodium Persulfate | 60 g |
| Sodium Chloride | 30 g |
| Phosphoric Acid (85%) | 11.8 ml |
| Sodium Hydroxide | 6.4 g |
| Illustrative compound (4) | 1.6 g |
| Water to make | 1 liter |
| pH | 2.9 |
| Bleaching solution (G): | |
| Water | 800 ml |
| Sodium Persulfate | 60 g |
| Sodium Chloride | 30 g |
| Phosphoric Acid (85%) | 11.8 ml |
| Sodium Hydroxide | 6.4 g |
| Illustrative compound (23) | 1.7 g |
| Water to make | 1 liter |
| pH | 3.0 |
| Bleaching solution (H): | |
| Water | 800 ml |
| Sodium Persulfate | 60 g |
| Sodium Chloride | 30 g |
| Phosphoric Acid (85%) | 11.8 ml |
| Sodium Hydroxide | 6.4 g |
| Illustrative compound (30) | 3.3 g |
| Water to make | 1 liter |
| pH | 2.8 |

TABLE 1

| Bleaching Solution | Chlorine Gas | Rusting | Generation of Odors Other Than Chlorine Gas |
|---|---|---|---|
| (A) | >100 ppm (after 1 day) | yes after 1 day | — |
| (B) | 60 ppm (after 7 days) | — | yes after 3 days |
| (C) | 1.3 ppm (after 7 days) | yes after 7 days | yes after 1 day |
| (D) | <0.1 ppm (after 7 days) | yes after 7 days | yes after 4 days |
| (E) | <0.1 ppm (after 7 days) | none | none |
| (F) | <0.1 ppm (after 7 days) | none | none |
| (G) | <0.1 ppm (after 7 days) | none | none |
| (H) | <0.1 ppm (after 7 days) | none | none |

As is clear from Table 1, in bleaching solution (A) containing no compound capable of preventing generation of chlorine gas, chlorine was generated immediately after preparation of the solution and after one day at 40° C., the concentration was above 100 ppm. Also, the iron piece in the polyethylene bottle began to rust after one day. Bleaching solution (B) containing the aliphatic amine showed a week chlorine generation-preventing effect, and the chlorine concentration reached 60 ppm after seven days. Also, odor other than chlorine gas began to be sensed after 3 days. As to bleaching solutions (C) and (D) containing known compounds described in *The Journal of Research Disclosure,* 17556 (November, 1978), odors began to be sensed after one day and the chlorine concentration reached 1.3 ppm and the iron piece began to rust after seven days in the case of solution (C) whereas with solution (D) odors began to be sensed after four days and the iron piece began to rust after seven days though the chlorine concentration was depressed at a level lower than 0.1 ppm even after seven days. Ingredients of the odor sensed with respect to solutions (B), (C), and (D) were not identified but they may be considered to be due to decomposition of the aliphatic amino group or carboxy group of the added compound, generation of hydrogen chloride, or both.

On the other hand, in bleaching solutions (E) to (H) containing the compounds of the present invention, the chloride concentration was depressed at a level lower than 0.1 ppm after seven days, no rusting took place, and odors which was formed or generated with respect to bleaching solutions (B), (C), and (D) was not formed at all. As is described above, the bleaching solutions containing the compounds of the present invention showed extremely effective abilities to prevent generation of chlorine gas, odors other than chlorine gas, and rusting.

The total processing steps using the bleaching solution containing the compound of the present invention will be exemplified below.

EXAMPLE 2

On a sub-coated or pre-coated polyethylene terephthalate support were coated, in sequence, the following emulsions.

First layer (red-sensitive emulsion layer)

An emulsion, prepared by adding 500 g of a gelatin solution containing emulsified and dispersed therein cyan coupler (C-1) (molar ratio of silver to the coupler: 7:1), 50 cc of a 1% aqueous solution of stabilizing agent (A-1), 50 cc of a 1% aqueous solution of coating agent (T-1), and 20 cc of a 2% aqueous solution of hardening agent (H-1) to 1000 g of a silver bromoiodide emulsion (AgI: 5 mol %) containing 10 g of silver halide and 5 g of gelatin per 100 g of the emulsion, was coated in a dry thickness of 4μ.

Second layer (interlayer)

A gelatin solution, prepared by adding 100 g of a gelatin aqueous solution containing emulsified and dispersed therein color stain-preventing agent (A-2), 50 cc of a 1% aqueous solution of coating agent (T-1) and 20 cc of a 2% aqueous solution of hardener (H-1) to 1,000 g of a 5% gelatin aqueous solution, was coated in a dry thickness of 1μ.

Third layer (green-sensitive emulsion layer)

An emulsion, prepared by adding 700 g of a gelatin solution containing emulsified and dispersed therein magenta coupler (C-2) (molar ratio of silver to the coupler=7:1), 50 cc of a 1% aqueous solution of stabilizer (A-1), 50 cc of a 1% aqueous solution of coating agent (T-1), and 20 cc of a 2% aqueous solution of hardener (H-1) to 1,000 g of a silver bromoiodide emulsion (silver iodide: 5 mol %) containing 10 g of silver halide and 5 g of gelatin per 100 g of the emulsion, was coated in a dry thickness of 4μ.

Fourth layer (yellow filter layer)

A solution, prepared by adding 100 cc of a 1% aqueous solution of coating agent (T-1) and 20 cc of a 2% aqueous solution of hardener (H-1) to 1,000 g of a 5% gelatin aqueous solution containing dispersed therein colloidal silver, was coated in a silver amount of 0.5 mg/100 $cm^2$.

Fifth layer (blue-sensitive emulsion layer)

An emulsion, prepared by adding 500 g of a gelatin solution containing emulsified and dispersed therein yellow coupler (C-3) (molar ratio of silver to the coupler=7:1), 50 cc of a 1% aqueous solution of stabilizing agent (A-1), 50 cc of a 1% aqueous solution of coating agent (T-1), and 20 cc of a 2% aqueous solution of hardener (H-1) to 1,000 g of a silver bromoiodide emulsion (AgI: 5 mol %) containing 10 g of silver halide and 5 g of gelatin per 100 g of the emulsion, was coated in a dry thickness of 4μ.

Sixth layer (protective layer)

A gelatin solution, prepared by adding 100 cc of a 1% aqueous solution of coating agent (T-1) and 20 cc of a 1% aqueous solution of hardener (H-1) to a 5% gelatin aqueous solution, was coated in a dry thickness of 1μ.

Couplers C-1, C-2, and C-3 are defined below.

(C-1)

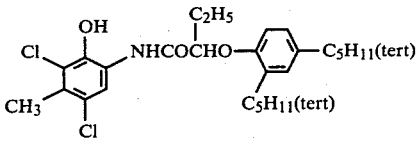

(C-2)

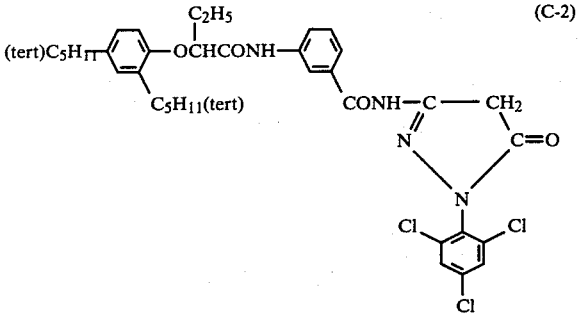

(C-3)

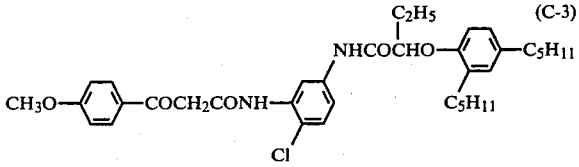

The couplers for the red, green and blue sensitive emulsions were emulsified by dissolving 75 g of cyan coupler (C-1), 75 g of magenta coupler (C-2) and 90 g of yellow coupler (C-3) respectively, in a mixture of 100 cc of dibutyl phthalate and 200 cc of ethyl acetate, and the resulting solution was emulsified in 600 g of a 10% gelatin aqueous solution with the help of a dispersing aid.

Compounds A-1, A-2, T-1 and H-1 are defined below.

(A-1)

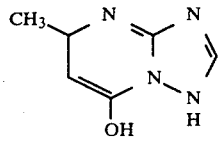

(A-2)

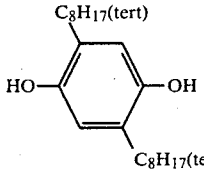

-continued (T-1)

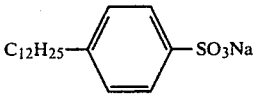

(H-1)

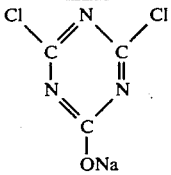

The color stain-preventing agents were emulsified by dissolving 100 g in a mixture of 200 cc of dibutyl phthalate and 200 cc of ethyl acetate, and the resulting solution was emulsified in 500 g of a 10% gelatin aqueous solution with the help of a dispersing aid.

The thus obtained color reversal film samples were subjected to imagewise exposure, and development-processing as follows using various bleaching baths containing the compounds of the present invention.

| | | | |
|---|---|---|---|
| First Development | 43° C. | 2 min. | |
| First Stopping | 40° C. | | 20 sec. |
| Washing with water | " | | 40 sec. |
| Second Development | 46° C. | 2 min. and | 15 sec. |
| Pre-bath | 40° C. | | 15 sec. |
| Washing with water | " | | 5 sec. |
| Bleaching | " | | 45 sec. |
| Fixing | 40° C. | | 40 sec. |
| Washing with water | " | | 25 sec. |
| Stabilizing | " | | 20 sec. |
| First Developer: | | | |
| Water | | | 800 ml |
| Quodrafos (trademark for a product manufactured by Merck & Co.) | | | 2.0 g |
| Anhydrous Sodium Bisulfite | | | 8.00 g |
| Phenidone | | | 0.35 g |
| Anhydrous Sodium Sulfite | | | 37.0 g |
| Hydroquinone | | | 5.50 g |
| Anhydrous Sodium Carbonate | | | 28.2 g |
| Sodium Rhodanate | | | 1.38 g |
| Sodium Bromide | | | 1.30 g |
| Potassium Iodide (1% solution) | | | 13.0 ml |
| Water to make | | | 1.00 liter |
| pH | | | 9.90 |
| First Stopping Solution | | | |
| Water | | | 800 ml |
| Glacial Acetic Acid | | | 30.0 ml |
| Sodium Hydroxide | | | 1.65 g |
| Water to make | | | 1.00 liter |
| pH | | | 3.50 |
| Second Developer | | | |
| Water | | | 800 ml |
| Sodium Hexametaphosphate | | | 5.0 g |
| Benzyl Alcohol | | | 4.50 ml |
| Anhydrous Sodium Sulfite | | | 7.50 g |
| Sodium Tertiary Phosphate ($12H_2O$) | | | 36.0 g |
| Sodium Bromide | | | 0.90 g |
| Potassium Iodide (0.1% solution) | | | 90 ml |
| Sodium Hydroxide | | | 3.25 g |
| Citrazinic Acid | | | 1.50 g/l |
| N-Ethyl-N-methanesulfonamido-ethyl-3-methyl-4-aminoaniline sesquisulfate monohydrate | | | 11.0 g |
| Ethylenediamine | | | 3.00 g |
| tert-Butylamineborane | | | 0.07 g |
| Water to make | | | 1.00 liter |
| pH | | | 11.65 |
| Pre-bath | | | |
| Water | | | 800 ml |
| Glacial Acetic Acid | | | 10 ml |
| Anhydrous Sodium Sulfite | | | 12 g |
| 2-N,N-Dimethylaminoethyl-thiuronium chloride hydrochloride | | | 4.4 g |
| Water to make | | | 1 liter |

-continued

| | |
|---|---|
| pH | 3.5 |
| Bleaching Solution | |
| Water | 800 ml |
| Sodium Persulfate | 60 g |
| Sodium Chloride | 30 g |
| Phosphoric Acid (85%) | 11.8 ml |
| Sodium Hydroxide | 6.4 g |
| Compound of the present invention or known compound | See Table 2 |
| Water to make | 1 liter |
| Fixing Solution | |
| Water | 600 ml |
| Ammonium Thiosulfate (58%) | 169 ml |
| Anhydrous Sodium Sulfite | 11.5 g |
| Disodium Ethylenediaminetetraacetate | 0.5 g |
| Anhydrous Sodium Acetate | 12 g |
| Glacial Acetic Acid | 9 ml |
| Water to make | 1 liter |
| pH | 5.5 |
| Stabilizing Solution | |
| Water | 800 ml |
| Formalin (37.5%) | 6 ml |
| Water to make | 1 liter |

After development processings, the amount of silver remaining in each film sample was determined by X-ray fluorometry. Also, after conducting these processing steps for continuous two weeks, the bleachng solutions were subjected to measurement to determine the change in pH and in electric potential using a platinum electrode and a saturated calomel electrode. The results thus obtained are shown in Table 2.

TABLE 2

| Bleaching Solution | (I) | (J) | (K) | (L) | (M) |
|---|---|---|---|---|---|
| Chlorine Gas Preventing Agent | none | (Known) $NH_2CH_2CH_2COOH$ (β-alanine) | Compounds of the Present Invention (3) | (4) | (16) |
| Amount Added (g/l) | — | 2.0 | 1.5 | 1.6 | 1.7 |
| Silver Remaining ($\mu g/cm^2$) | 2.4 | 2.4 | 2.3 | 2.2 | 2.5 |
| Change in pH | 2.7→ 1.9 | 3.4→ 1.9 | 2.9→ 1.7 | 2.9→ 1.7 | 3.0→ 1.7 |
| Change in Potential (vs S.C.E.) (mV) | 1000→ 1150 | 800→ 840 | 760→ 800 | 760→ 800 | 740→ 780 |

As shown in Table 2, the film samples processed in the bleaching solutions containing the compounds of the present invention underwent acceleration of silver removal similarly with the film samples processed in the bleaching solutions containing no or known compounds, thus providing distinct color images. The thus obtained color images were confirmed to be by no means inferior to the color images obtained by standard processing using other bleaching agents, for example, red prussiate as a bleaching agent in color density, linearity-retaining property of characteristic curve, and stability against heat and light.

This silver-removing ability was maintained at almost the same level even after two weeks, and there were observed no differences in the ability between the film samples processed in processing solutions (I) to (M). As to change in pH over two weeks, bleaching solution (I) containing no compounds of the present invention underwent the least change, and the bleaching solutions (K) to (M) containing the compounds of the present invention underwent less change than the bleaching solution (J) containing the known compound. Thus, the bleaching solutions in accordance with the present invention had a more stable bleaching power than that of the bleaching solution (J). As to the change in electric potential, bleaching solution (I) underwent the most change, and the change was as high as 150 mV, which implies generation of chlorine. On the other hand, bleaching solutions (J) to (M) underwent a change of only 40 mV, which explains the depressed generation of chlorine.

As a consequence, the compounds of the present invention have enabled to conduct rapid development processing with less environmental pollution.

EXAMPLE 3

On a sub-coated or pre-coated cellulose triacetate film base were coated, in sequence, the following first to eleventh layers to prepare color negative film samples.

First layer (anti-halation layer)

A gelatin layer containing black colloidal silver.

Second layer (interlayer)

A gelatin layer containing an emulsion of 2,5-di-t-octylhydroquinone.

Third layer (low-speed red-sensitive emulsion layer)

2.2 g silver/$m^2$ of a low sensitive AgBrI emulsion (AgI: 6 mol %; average grain size: 0.8μ; gelatin 70 g/kg emulsion) containing:

| | |
|---|---|
| Sensitizing dye I | $3.0 \times 10^{-4}$ mol/mol silver |
| Sensitizing dye II | $0.8 \times 10^{-4}$ mol/mol silver |
| Coupler A | $160 \times 10^{-5}$ mol/$m^2$ |
| Coupler B | $19 \times 10^{-5}$ mol/$m^2$ |
| DIR coupler F | $2 \times 10^{-5}$ mol/$m^2$ |

Fourth layer (high-speed red-sensitive emulsion layer)

2.4 g silver/$m^2$ of a high sensitive AgBrI emulsion (AgI: 5 mol %; average grain size: 1.2μ; gelatin 70 g/kg emulsion) containing:

| | |
|---|---|
| Sensitizing dye I | $1.5 \times 10^{-4}$ mol/mol silver |
| Sensitizing dye II | $0.4 \times 10^{-4}$ mol/mol silver |
| Coupler A | $27 \times 10^{-5}$ mol |

Fifth layer (interlayer)

The same as the second layer.

Sixth layer (low-speed green-sensitive emulsion layer)

1.9 g silver/$m^2$ of a low sensitive AgBrI emulsion (AgI: 7 mol %; average grain size: 0.8μ; gelatin 70 g/kg emulsion) containing:

| | |
|---|---|
| Sensitizing dye III | $4.0 \times 10^{-4}$ mol/mol silver |
| Sensitizing dye IV | $0.5 \times 10^{-4}$ mol/mol silver |
| Coupler C | $74 \times 10^{-5}$ mol/$m^2$ |
| Colored coupler D | $12 \times 10^{-5}$ mol/$m^2$ |

-continued

| | |
|---|---|
| DIR coupler F | $3.6 \times 10^{-5}$ mol/m$^2$ |

Seventh layer (high-speed green-sensitive emulsion layer)

1.8 g silver/m$^2$ of a high sensitive AgBrI emulsion (AgI: 8 mol %; average grain size: 1.2$\mu$; gelatin 70 g/kg emulsion) containing:

| | |
|---|---|
| Sensitizing dye III | $2.0 \times 10^{-4}$ mol/mol silver |
| Sensitizing dye IV | $0.3 \times 10^{-4}$ mol/mol silver |
| Coupler C | $22 \times 10^{-5}$ mol/m$^2$ |
| Colored coupler D | $4 \times 10^{-5}$ mol/m$^2$ |

Eighth layer (yellow filter layer)

A gelatin layer containing an emulsion dispersion of yellow colloidal silver and 2,5-di-t-octylhydroquinone.

Ninth layer (low-speed blue-sensitive emulsion layer)

0.8 g/m$^2$ of a low sensitive AgBrI emulsion (AgI: 7 mol %; average grain size: 0.8$\mu$; gelatin 70 g/kg emulsion) containing:

| | |
|---|---|
| Coupler E | $150 \times 10^{-5}$ mol/m$^2$ |
| DIR coupler | $2 \times 10^{-5}$ mol/m$^2$ |

Tenth layer (high-speed blue-sensitive emulsion layer)

0.9 g/m$^2$ of a high sensitive AgBrI emulsion (AgI: 8 mol %; average grain size: 1.3$\mu$; gelatin 70 g/kg emulsion) containing:

| | |
|---|---|
| Coupler E | $22 \times 10^{-5}$ mol/m$^2$ |

Eleventh layer (protective layer)

A gelatin layer.

Each of the above-described layers contained a gelatin hardener, a coating aid, etc. in addition to the above-described ingredients.

Materials Used:

Sensitizing dye I: anhydro-5,5'-dichloro-3,3'-disulfopropyl-9-ethyl-thiacarbocyaninehydroxide pyridinium salt Sensitizing dye II: anhydro-9-ethyl-3,3'-di-(3-sulfopropyl)-4,5,4',5'-dibenzothiacarbocyaninehydroxide triethylamine salt Sensitizing dye III: anhydro-9'-ethyl-5,5'-dichloro-3,3'-disulfopropyloxacarbocyanine sodium salt Sensitizing dye IV: anhydro-5,6,5',6'-tetrachloro-1,1'-diethyl-3,3'-di(sulfopropoxyethoxyethyl-)imidazolocarbocyanine-hydroxide sodium salt Coupler A: 1-hydroxy-N-[$\gamma$-(2,4-di-t-amyl-phenoxy-propyl)]-2-naphthamide Coupler B: 1-hydroxy-4-{2-(2-hexyldecyloxycarbonyl)-phenylazo}-2-{N-(1-naphthal)}naphthamide Coupler C: 1-(2,4,6-trichlorophenyl)-3-{3-[$\alpha$-(2,4-di-t-amylphenoxy)acetamido]-benzamido}-5-pyrazolone Coupler D: 1-(2,4,6-trichlorophenyl)-3-[3-{$\alpha$-2,4-di-t-amylphenoxy)acetamido}-benzamido]-4-methoxy-phenylazo-5-pyrazolone Coupler E: $\alpha$-(2,4-dioxo-5,5'-dimethyloxazolidinyl)-$\alpha$-pivaloyl-2-chloro-5-{$\alpha$-(2,4-di-t-amylphenoxy)-butyramido}-acetanilide Coupler F: a mixture of $\alpha$-{5-(3-methyl-2-benzothiazolylideneamino)-1-benzotriazolyl}-$\alpha$-(4-octadecyloxybenzoyl)-2-ethoxy-acetanilide and $\alpha$-{6-(3-methyl-2-benzothiazolylideneamino)-1-benzothiazolyl}-$\alpha$-(4-octadecyloxybenzoyl)-2-ethoxy-acetanilide Emulsions of the above-described couplers were prepared by dissolving respective couplers in a mixture of dibutyl phthalate and tricresul phosphate, and dispersing in a gelatin solution as an O/W type emulsion using sorbitan monolaurate, sulfonated oil, and sodium dodecylbenzene-sulfonate as dispersing and emulsifying agents.

The thus prepared photographic elements were imagewise exposed (1/50 second; 10 C.M.S.) using a sensitometer, and subjected to development processing at 38° C. according to the following steps.

| | |
|---|---|
| 1. Color Development | 3 min. & 15 sec. |
| 2. Pre-bath | 30 sec. |
| 3. Bleaching | 2 min. |
| 4. Fixing | 3 min. & 15 sec. |
| 5. Washing | 2 min. & 10 sec. |
| 6. Stabilizing | 30 sec. |

Formulation of the processing solutions used in the respective steps was the same as that shown in that Example 2, except for the color developer and bleaching solution, which are described below.

| | |
|---|---|
| Color developer | |
| Trisodium Nitrilotriacetate | 1.9 g |
| Sodium Sulfite | 4.0 g |
| Sodium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-$\beta$-hydroxyethylamino)-2-methylaniline sulfate | 4.5 g |
| Water to make | 1 liter |
| pH | 10.0 |
| Bleaching Solution | |
| Water | 800 ml |
| Sodium Persulfate | 60 g |
| Sodium Chloride | 30 g |
| Phosphoric Acid (85%) | 11.8 ml |
| Sodium Hydroxide | 6.4 g |
| Compound of the present invention or known compound | See Table 3 |
| Water to make | 1 liter |

TABLE 3

| Bleaching Solution | (N) | (O) | (P) | (Q) | (R) |
|---|---|---|---|---|---|
| Compound added to bleaching solution | none | $\beta$-alanine | (4) | (19) | (23) |
| Amount Added (g/l) | — | 2.0 | 1.6 | 1.5 | 2.7 |
| Amount of Silver Remaining ($\mu$g/cm$^2$) | 2.5 | 2.5 | 2.2 | 2.5 | 2.3 |

As is shown in Table 3, the film samples processed in bleaching solutions (P) to (R) containing the compounds of the present invention underwent the same acceleration of silver removal as, or more than, the film processed in the bleaching solutions containing no or known compounds, and provided distinct color images. Also, the thus obtained color images were confirmed to be by no means inferior to the color images obtained according to standard processing using other bleaching agents, for example, red prussiate in photographic properties.

While the invention has been described in detail and with reference to specific embodiments thereof, it will be apparent to one skilled in the art that various changes and modifications can be made therein without departing from the spirit and scope thereof.

What is claimed is:

1. A bleaching composition for use in processing silver halide color photographic light-sensitive material, comprising compounds [I], [II], and [III] as follows:

Compound [I]: at least one persulfate;

Compound [II]: a water-soluble halide; and

Compound [III]: at least one compound selected from the compounds represented by following general formula [III];

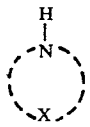

wherein X represents carbon atoms or carbon and nitrogen atoms forming an unsubstituted or substituted 5-membered ring containing two unsaturated bonds, including a 5-membered ring fused with a 5- or 6-membered carbocyclic or heterocyclic ring.

2. The bleaching composition of claim 1, wherein said compound [II] is a chloride.

3. The bleaching composition of claim 1, wherein said compound [II] is a bromide.

4. The bleaching composition of claim 2, wherein said chloride is potassium chloride, sodium chloride or ammonium chloride.

5. The bleaching composition of claim 3, wherein said bromide is potassium bromide, sodium bromide, or ammonium bromide.

6. The bleaching composition of claim 1, wherein said compound [III] contains at least two nitrogen atoms forming a 5-membered ring containing two unsaturated bonds.

7. The bleaching composition of claim 1, wherein said compound [III] is imidazole or an alkyl-substituted imidazole.

8. The bleaching composition of claim 1, wherein said compound [III] is benzimidazole, benzotriazole, or a substituted derivative thereof.

9. The bleaching composition of claim 1, wherein said compound [III] is represented by the formula [III-a]

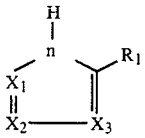

[III-a]

wherein $X_1$, $X_2$, and $X_3$ may be the same or different and each represents a nitrogen atom or a

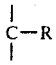

group, wherein R and $R_1$ may be same or different, and each represents a hydrogen atom, a straight chain or branched chain alkyl group, a straight chain or branched chain alkenyl group, a monocyclic aryl group having 6 to 8 carbon atoms, a straight chain alkoxy group, an amino group, an acyl group, a cyano group, a nitro group, a sulfo group, or a halogen atom (e.g., chlorine or bromine).

10. The bleaching composition of claim 1, wherein compound [III] is represented by the formula [III-b]

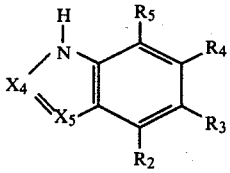

[III-b]

wherein $X_4$ and $X_5$ may be the same or different and each represents a nitrogen atom or a

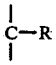

group and R, $R_2$, $R_3$, $R_4$, and $R_5$ may be the same or different, and each represents a hydrogen atom, a straight chain or branched chain alkyl group, a straight chain or branched chain alkenyl group, a monocyclic aryl group having 6 to 8 carbon atoms, a straight chain alkoxy group, an amino group, an acyl group, a cyano group, a nitro group, a sulfo group, or a halogen atom (e.g., chlorine or bromine).

11. The bleaching composition of claim 1, wherein said 5-membered ring completed by X is a pyrrole ring, an imidazole ring, a pyrazole ring, a 1,2,3-triazole ring, a 1,2,4-triazole ring, a tetrazole ring, an indole ring, an indazole ring, a benzimidazole ring, a benzotrazole ring, a triazaindene ring, a tetrazaindene ring.

12. The bleaching composition of claim 1, wherein said persulfate is potassium persulfate, sodium persulfate, or ammonium persulfate.

13. A photographic bleaching process, wherein the bleaching is carried out with a composition comprising Compounds [I], [II] and [III] as follows:

Compound [I]: at least one persulfate;

Compound [II]: a water-soluble halide; and

Compound [III]: at least one compound selected from the compounds represented by following general formula [III];

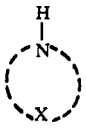

wherein X represents carbon atoms or carbon and nitrogen atoms forming an unsubstituted or substituted 5-membered ring containing two unsaturated bonds, including a 5-membered ring fused with a 5- or 6-membered carbocyclic or heterocyclic ring.

14. The process of claim 13, wherein said processing additionally comprises using as a bleaching accelerator a mercapto compound represented by the following general formula [IV]:

$$X—A—SH \qquad [IV]$$

wherein A represents an alkylene group or a nitrogen-containing an unsaturated divalent heterocyclic ring, and X represents an alkyl-substituted or unsubstituted amino group, a nitrogen-containing saturated heterocyclic ring, a hydroxy group, a carboxy group or a sulfo group, or a precursor thereof.

15. The process of claim 14, wherein said bleaching accelerator is a compound represented by the following general formula [V]:

$$X—(CH_2)_n—SH \qquad [V]$$

wherein X represents an N,N-dimethylamino group, an N,N-diethylamino group, a hydroxy group or a sulfo group, and n represents an integer of 2 or 3 or a precursor thereof.

16. The process of claim 14 or 15, wherein said bleaching accelerator is used in the bleaching bath.

17. The process of claim 13, wherein said bleaching accelerator is selected from the group consisting of

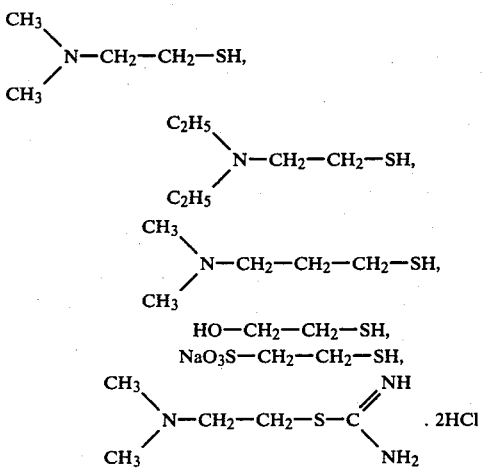

-continued

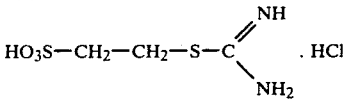

18. The process of claim 13, wherein the bleaching is carried out at a temperature of from about 20° C. to 60° C.

19. The process of claim 18, wherein the bleaching is carried out at a temperature between 30° C. and 40° C.

20. The process of claim 13, wherein the bleaching is carried out for a time of from about 1 to 8 minutes.

21. The process of claim 20, wherein the bleaching is carried out for a time of from 1.5 to 6 minutes.

22. The process of claim 13, wherein said persulfate is potassium persulfate, sodium persulfate, or ammonium persulfate.

23. The process of claim 13, wherein said bleaching follows a color development.

24. The process of claim 13, wherein said bleaching occurs in the following processing sequence of a color photographic element: color development, stopping, bleaching, washing, fixing, washing, stabilizing and drying.

25. The process of claim 13, wherein said bleaching occurs in the following processing sequence of a color photographic element: color development, stopping, bleaching, fixing, washing, stabilizing and drying.

26. The process of claim 13, wherein said bleaching occurs in the following processing sequence of a color photographic element: color development, stop-fixing, bleaching, fixing, washing, stabilizing and drying.

27. The process of claim 13, wherein said bleaching occurs in the following processing sequence of a color photographic element: black-and-white development, stopping, washing, fogging, washing, color development, stopping, washing, bleaching, washing, fixing, washing, stabilizing and drying.

28. The process of claim 13, wherein said bleaching occurs in the following processing sequence of a color photographic element: black-and-white development, stopping, washing, fogging, washing, color development, stopping, washing, bleaching, fixing, washing, stabilizing and drying.

* * * * *